US006859133B2

(12) United States Patent
Nakanishi et al.

(10) Patent No.: US 6,859,133 B2
(45) Date of Patent: Feb. 22, 2005

(54) RESISTOR

(75) Inventors: Tsutomu Nakanishi, Osaka (JP); Takashi Morino, Osaka (JP); Tadao Yagi, Fukui (JP); Tetsuhiro Korechika, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 20 days.

(21) Appl. No.: 10/258,905

(22) PCT Filed: Feb. 28, 2002

(86) PCT No.: PCT/JP02/01883

§ 371 (c)(1),
(2), (4) Date: Feb. 21, 2003

(87) PCT Pub. No.: WO02/071418

PCT Pub. Date: Sep. 12, 2002

(65) Prior Publication Data

US 2003/0156008 A1 Aug. 21, 2003

(30) Foreign Application Priority Data

Mar. 1, 2001 (JP) ..... 2001-56503

(51) Int. Cl.[7] ..... H01C 1/012

(52) U.S. Cl. ..... 338/309; 338/313; 338/327; 338/332

(58) Field of Search ..... 338/309, 313, 338/327, 332, 314, 328

(56) References Cited

U.S. PATENT DOCUMENTS 4,780,702 A * 10/1988 Snel et al. ..... 338/308
4,792,781 A * 12/1988 Takahashi et al. ..... 338/307
4,829,553 A * 5/1989 Shindo et al. ..... 338/309
5,258,738 A * 11/1993 Schat ..... 338/332
5,680,092 A * 10/1997 Yamada et al. ..... 338/309
5,952,911 A * 9/1999 Kawase et al. ..... 338/22 R
5,994,996 A * 11/1999 Van Den Broek et al. .. 338/308
6,023,217 A * 2/2000 Yamada et al. ..... 338/309
6,242,999 B1 * 6/2001 Nakayama et al. ..... 338/309
6,304,167 B1 * 10/2001 Nakayama ..... 338/195
6,636,143 B1 * 10/2003 Hashimoto et al. ..... 338/309

FOREIGN PATENT DOCUMENTS

JP 03-080501 4/1991
JP 4-102302 4/1992

OTHER PUBLICATIONS

Dummer, Materials for Conductive Resisitive Functions, Table 2.2 (1970).*
International Search Report corresponding to International Application No. PCT/JP02/01883 dated Jun. 4, 2002.
English translation of Form PCT/ISA/210.

* cited by examiner

*Primary Examiner*—Karl D. Easthom
(74) *Attorney, Agent, or Firm*—RatnerPrestia

(57) ABSTRACT

The resistor of the present invention comprises a substrate, a pair of upper electrode layers disposed on one surface of the substrate, and a resistor layer connected to the pair of upper electrode layers, wherein the upper electrode layer includes a first thin film layer that strongly adheres to the substrate and the resistor layer, and a second thin film layer having volume resistivity lower than the volume resistivity of the first upper electrode thin film layer. Further, the resistor of the present invention comprises a pair of side electrodes, electrically connected to the upper electrode layers, at the end portion of the substrate, and the side electrode includes a first side thin film layer and a second side thin film layer, and the material that forms the second side thin film layer has a solid solubility with the first side thin film layer.

12 Claims, 4 Drawing Sheets

RESISTOR

This Application is a U.S. National Phase Application of PCT International Application PCT/JP02/01883, filed Feb. 28, 2002.

TECHNICAL FIELD

The present invention relates to a resistor with side electrodes having excellent adhesive strength to a substrate.

BACKGROUND ART

As an example of conventional resistor, Japanese Patent Laid-open Publication H3-80501 discloses "a resistor having a 4-layer side electrode." The resistor comprises, as shown in FIG. 8, a resistor layer 13 connected to a pair of upper electrode layers 12 disposed at both of upper end portions of a substrate 11 and a pair of C-shaped side electrodes 14 disposed at both sides of the substrate 11 and electrically connected to the upper electrode layers 12. In the following description, the word "connection" means electrical connection.

The side electrode 14 has a laminated structure that comprises a C-shaped first metal thin film 15, formed of Ni—Cr thin film, Ti thin film or Cr thin film, which is the lowest layer connected to the upper electrode layer 12; a second metal thin film 16 formed of low resistance Cu thin film superposed on the first metal thin film 15; a first metal-plated layer 17 formed of Ni plated layer superposed on the second metal thin film 16; and further a second metal-plated layer 18 formed of Pb—Sn plated layer or Sn plated layer superposed on the first metal-plated layer 17.

In the case of a resistor disclosed in Japanese Patent Laid-open Publication H3-80501, since the upper electrode 12 and resistor layer 13 are fabricated by a thick film technology, and the second metal thin film 16 of the side electrode is formed of low resistance Cu thin film, there arises a problem such that the connection resistance is high between the upper electrode 12 and the resistor layer 13 and, in addition, the second metal thin film 16 is liable to peel off from the first metal thin film 1. That is, if the resistor is kept in a high humidity atmosphere, the Cu thin film 16 will be easier to peel off from the first metal thin film 15. The cause of this peel-off is thought that as there exists no solid solution between the Cu thin film 16 and the first metal thin film 15, water or the like is absorbed in the interface of them.

The present invention is intended to address the problem of the electrode in the above conventional resistor, and the object of the invention is to provide a resistor improved in reliability, which has low connection resistance and capable of realizing low wiring resistance, and also is improved in adhesive strength between the substrate and the upper electrode layer, between the substrate and the first thin film of side electrode, between the first thin film and the second thin film, and between the second thin film and the first plated film.

DISCLOSURE OF THE INVENTION

A resistor comprises a substrate, a pair of upper electrode layers disposed on one surface of the substrate, and a resistor layer connected to the pair of upper electrode layers, wherein the upper electrode layer is formed of a first thin film layer that strongly adheres to the substrate and the resistor layer, and a second thin film layer having resistivity (resistance between two faces of a cubic material) lower than the resistivity of the first upper electrode thin film layer.

Further, the resistor comprises, at the end portion of the substrate, a pair of side electrodes electrically connected to the upper electrode layer, wherein the side electrode includes a first side thin film layer and a second side thin film layer, and a material for forming the second side thin film layer has a solid solubility with the first side thin film layer.

DETAILED DESCRIPTION OF THE PREFERRED EMBODIMENTS

First Preferred Embodiment

A resistor in the first preferred embodiment of the present invention will be described in the following with reference to the drawings.

Figure 1:
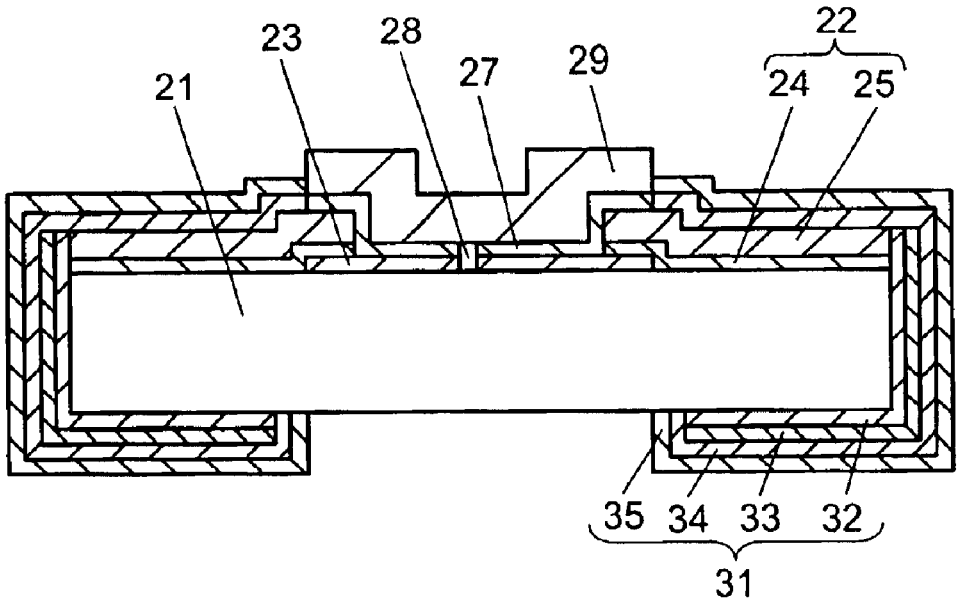
FIG. 1 is a sectional view of a resistor in the first preferred embodiment of the present invention.

As shown in FIG. 1, a resistor in the present invention comprises a substrate 21, and a pair of upper electrode layers 22 formed on a upper surface of the substrate 21, wherein a resistor layer 23 is connected to the pair of upper electrode layers 22.

Figure 2:
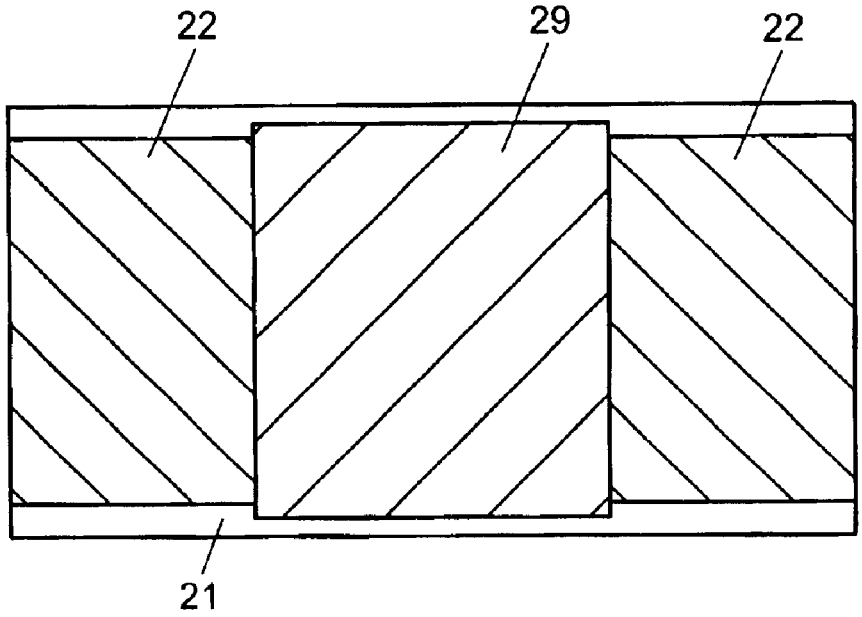
FIG. 2 is a top view of the resistor without side electrodes.

The resistor layer 23 is formed of Ni—Cr based or metal-Si based alloy thin film using thin film technologies such as a sputtering, a vacuum deposition, an ion plating, and a plasma CVD (P-CVD). The upper electrode layer 22 has a laminated structure formed of a first upper electrode thin film layer 24 contacting the substrate 21, and a second upper electrode thin film layer 25. The first thin film layer 24 is formed from a lengthwise end portion of the upper surface of the substrate 21 toward middle thereof, as shown in FIG. 2. The first thin film layer 24 is disposed in such manner that a part of it is overlapped on the resistor layer 23, which is formed of Cr thin film or Ti thin film by the thin film forming technologies such as sputtering, vacuum deposition, ion plating, and P-CVD.

The second thin film layer 25 is formed from the lengthwise end portion of the upper surface of the substrate 21 toward the middle thereof. The second thin film layer 25 is preferably overlapped on the upper layer of the first thin film layer 24 so as to cover the resistor layer 23, and is formed of Cr thin film or Cu based alloy thin film by the thin film forming technologies such as sputtering, vacuum deposition, ion plating, and P-CVD.

The resistor layer 23 is preferable covered with a first protective layer 27 made of glass or the like disposed on the upper surface of the resistor layer 23, and a trimming groove 28 for resistance adjustment is formed in the first protective layer 27 and the resistor layer 23 by means of a laser beam. Further, at least the resistor layer 23 or a portion where the resistor layer 23 is overlapped on the upper electrode layer 22, the first protective layer 27 and the trimming groove 28 are covered with the second protective layer 29 formed of resin or glass and the like. In this case, it is preferable to dispose the first and second protective layers 27, 29 at an inner side of the side portion of substrate 21, as shown in FIG. 2, in order to obtain a highly reliable resistor stabilized in resistance, lessening the occurrence of peeling of the first and second protective layers 27, 29 and also enhancing the covering ability in the sectional direction of resistor layer 23 when individual resistors are divided from a multi-piece sheet substrate or a strip substrate.

A pair of side electrode layers 31 are disposed at both end portions of the substrate 21 which have C-shaped and connected to the upper electrode layers 22 as needed. The side electrode layer 31 has a multi-layer structure comprising a first thin film 32 contacting the substrate 21, a second thin film 33, a first plated layer 34 and second plated layer 35. The first thin film 32 is formed in L shape covering the side and bottom surfaces of the substrate 21. The first thin film 32 is formed of one of Cr or Cr alloy thin film, Ti or Ti alloy thin film and Ni—Cr alloy thin film that has good adhesive strength to the substrate 21 by the thin film forming technologies such as sputtering, vacuum deposition, ion plating, and P-CVD. The second thin film 33 is formed in L shape covering the side and bottom surfaces of the substrate 21. The second thin film 33 is formed of Cu-based alloy thin film and is overlapped on the first thin film 32 by the thin film forming technologies such as sputtering, vacuum deposition, ion plating, and P-CVD. In the present preferred embodiment, an example of L shape forming of the first and second thin films 32, 33 which make up the side electrode layer 31 has been described, but it is also preferable to form the first and second thin films 32, 33 in C-shape which cover the upper, the side and the bottom surfaces of the end portion of the substrate 21.

The first plated layer 34 covers the exposed portion of the upper electrode layer 22 and the second thin film 33. As the first plated layer 34, an Ni plated layer is formed, which is a excellent solder diffusion barrier and has an excellent heat resistance. Further, the second plated layer 35 covers the first plated layer 34, for which Pb—Sn plated layer, Sn plated layer or lead-free solder having excellent solderability is used as the material.

The second thin film 33 of the side electrode layer 31 having a configuration as described above will be described in detail in the following.

It is preferable to use Cu-based alloy thin film, Cu—Ni alloy thin film in particular, as the material for the second thin film 33.

In Cu—Ni alloy, Ni makes up a "total ratio solid solution" such that Ni is uniformly dissolved with copper at a total composition ratio (range) of Cu, main element of the thin film. Therefore, when Cu—Ni alloy thin film is employed for the second thin film 33, a strong adhesive layer is formed since Ni is diffused over the interface between the second thin film 33 and the first thin film 32, and thereby, it is possible to improve the adhesive strength. Also, Ni existing on an outer surface of the second thin film 33 effectively enhances the corrosion resistance against the plating solution for Ni plating used for the first plated layer 34. Further, since Ni is diffused over the interface between the second thin film 33 and the first plated layer 34, the adhesive strength at the interface between the plated layer 34 and the thin film 33 can be improved.

Figure 3:
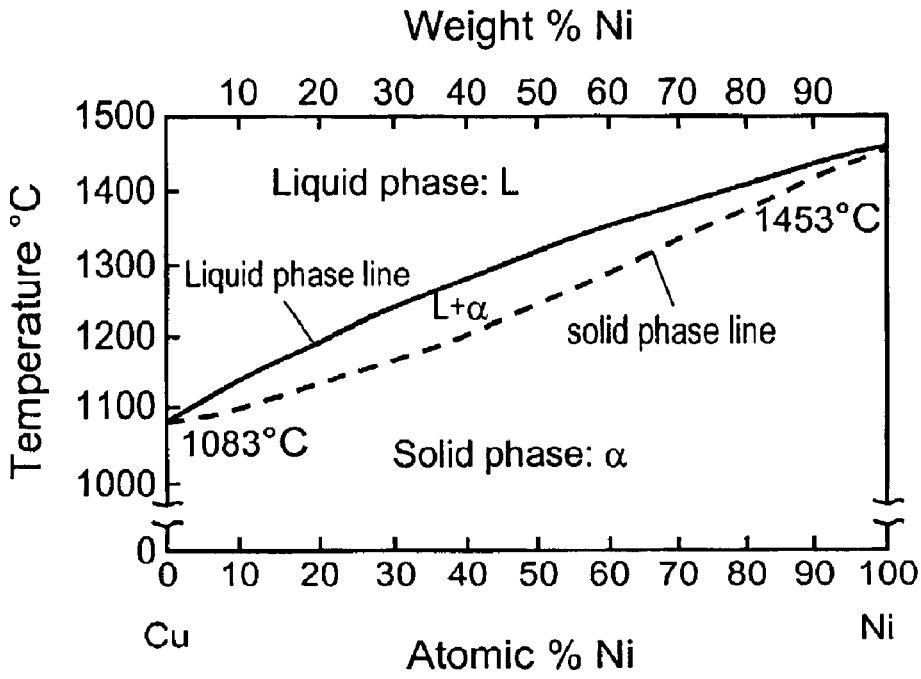
FIG. 3 is an equilibrium diagram of Cu—Ni alloy thin film used as the second thin film of the present invention.

Here, the above-mentioned "total ratio solid solution" is described. An equilibrium diagram of Cu—Ni alloy thin film as the second thin film is as shown in FIG. 3. In FIG. 3, the horizontal axis stands for the composition of Ni metal added, and the vertical axis stands for the temperatures. It is in a state of liquid phase when the temperature is higher than the liquid phase line shown by a continuous line, and in a state of solid phase when the temperature is lower than the solid phase line shown by a dotted line. The second thin film 33 formed of Cu—Ni alloy thin film in the present preferred embodiment is such that Ni metal atom having a crystal structure of same face-centered cubic lattice is dissolved in Cu metal of face-centered cubic lattice, mother metal, and thereby, a substitution solid solution having a face-centered cubic lattice structure is formed as one phase over the entire range of the composition.

Figure 4:
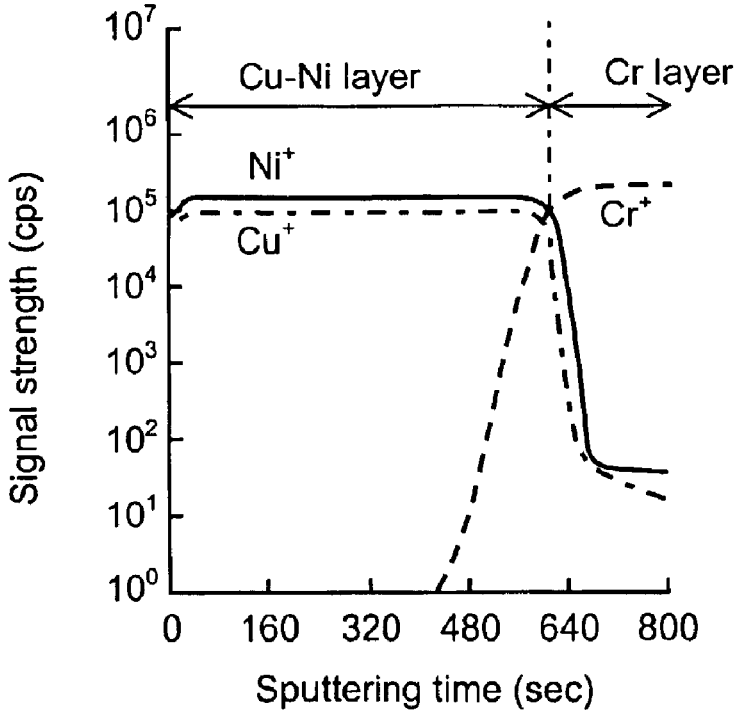
FIG. 4 is an explanatory diagram of the results of composition analysis by SIMS of the first thin film and the second thin film.

Also, a results of a composition analysis by a secondary ion mass analysis spectrometry (SIMS) is shown in FIG. 4 with respect to the interface between the first thin film 32 made of Cr metal and the second thin film 33 made of Cu—Ni alloy thin film. In this case, the amount of Ni added of the second thin film 33 is 6.2 atomic %. In FIG. 4, the horizontal axis stands for a film thickness from Cu—Ni alloy thin film surface shown by sputtering time, and the vertical axis shows a number of atomic Cu, Ni, Cr or the like in each layer. As is obvious from FIG. 4, there exists a diffusion layer where each of Cu, Ni and Cr exists at the interface between Cu—Ni alloy thin film layer and Cr metal layer. On the other hand, Ni metal is uniformly existing in Cu metal ranging from Cu—Ni alloy thin film surface to the interface with Cr layer. Thus, it shows that the second thin film 33 made of Cu—Ni is a "total ratio solid solution," forming one phase with Ni alloy completely dissolved in Cu metal. An example of the amount of 6.2 atomic % Ni added is described as the composition of the second thin film 33 made of Cu—Ni alloy thin film in the explanation, but the present invention is not limited to this composition, and same results as in FIG. 4 is obtained over the entire range of the composition.

As for a resistor having a configuration as described above, the adhesive strength of the plated layer to the substrate in use of Cu—Ni alloy thin film as the second thin film will be described in the following.

Figure 5:
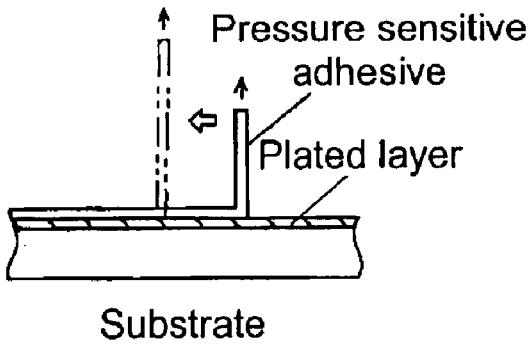
FIG. 5 is an illustration for describing the test method for evaluating the adhesive strength of plated layer.
Figure 6:
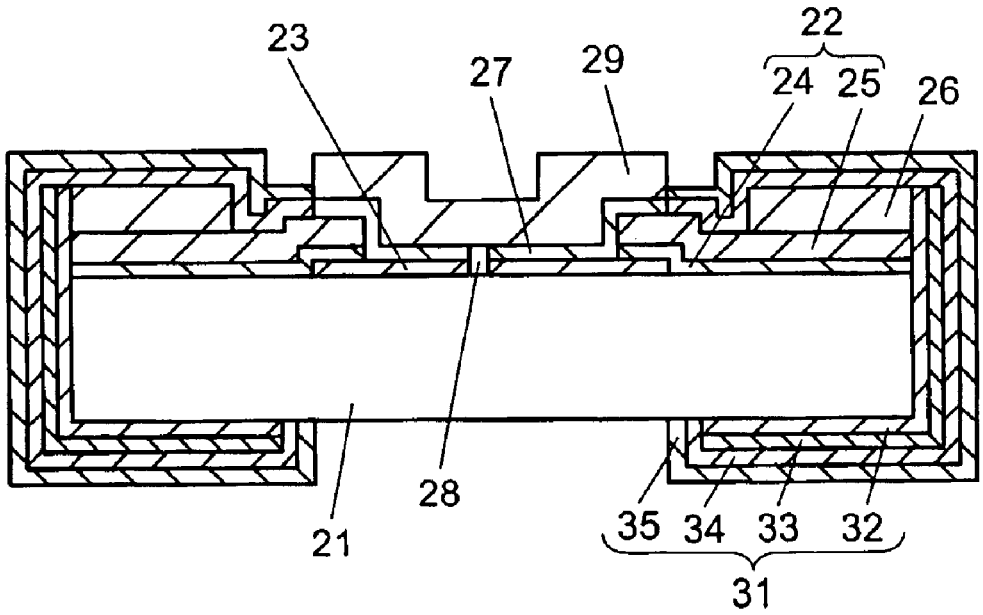
FIG. 6 is a sectional view of a resistor in the second preferred embodiment of the present invention.
Figure 7:
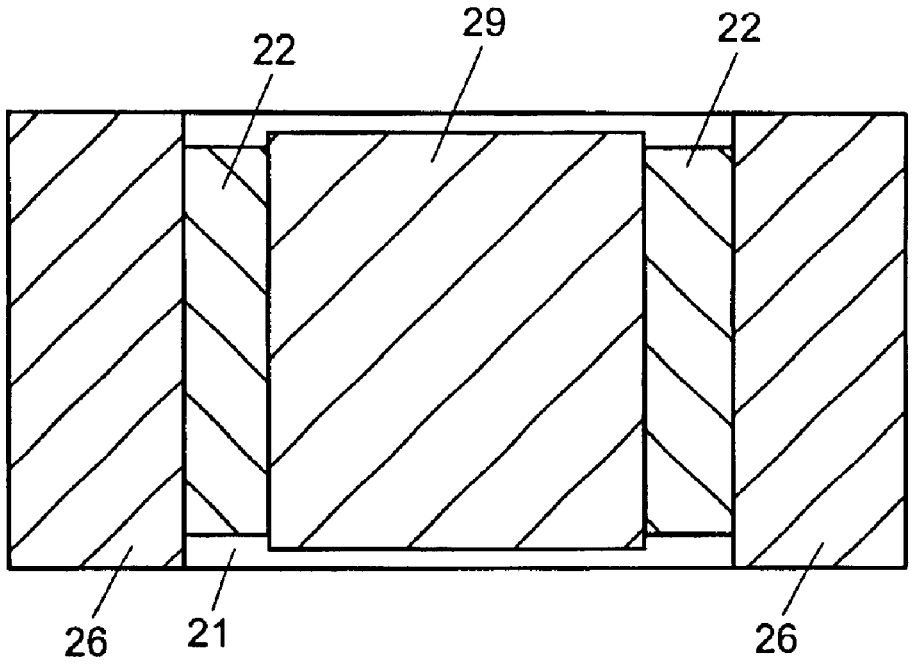
FIG. 7 is a top view of the resistor without the side electrode.
Figure 8:
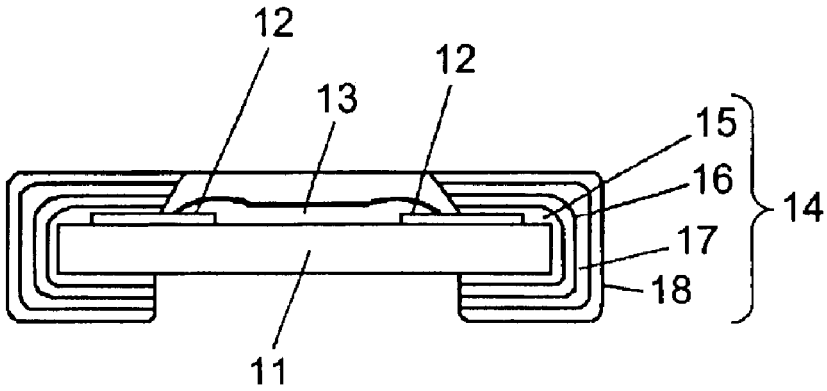
FIG. 8 Prior Art
FIG. 8 is a sectional view of a conventional resistor.

As a test method, the test is executed according to the method specified in "adhesive strength test method of plating/JIS H8504C," and the testing tape used is pressure sensitive adhesive tape of 18 mm in width specified in "cellophane pressure sensitive adhesive tape/JIS Z 1522." In this case, the direction of peeling the adhesive tape is vertical to the substrate as shown in FIG. 5(*a*), as specified in "JIS H 8504."

In the test method, an alumina substrate is used as a test piece, and Cr thin film is formed, by a sputtering process, as the first thin film 32 on the side surface of the test piece. Next, Cu—Ni alloy thin film is formed as the second thin film 33 by a sputtering process the same as the first thin film 32. After that, a pattern of 0.3 mm in width is formed by means of a laser beam.

Regarding the specimen subjected to an accelerated test under a condition of temperature of 65 C and relative humidity of 95%, a pressure sensitive adhesive cellophane tape is adhered tightly to the surface of the plated layers formed in pattern, and the tape was removed at a quick motion, then a ratio of a number of layer-removed patterns against a total number of patterns was obtained for the purpose of adhesive strength evaluation.

Also, regarding the test piece for evaluation of the adhesive strength at the interface between the first plated layer 34 and the second thin film 33, after forming the second thin film 33, the first plated layer 34 was formed by Ni plating, and the second plated layer 35 was formed by electrolytic solder plating in order to prepare the test piece.

The evaluation was performed with against "1.6 wt %", "6.2 wt %" and "12.6 wt %" as the amount of Ni added in Cu—Ni alloy thin film, and for the purpose of comparison, those with Ni added by "0 wt %" were used.

The evaluation results of the peeling ratio at the interface between the second thin film 33 and the first thin film 32 after 500 hours of the accelerated test are shown in Table 1.

TABLE 1

| Ni added (wt %) | 0 | 1.6 | 6.2 | 12.6 |
|---|---|---|---|---|
| Peeling ratio (%) | 35.0 | 0.0 | 0.0 | 0.0 |

As is apparent from Table 1, when Ni is added into Cu thin film, the adhesive strength at the interface between the second thin film 33 and the first thin film 32 is greatly improved.

Next, the evaluation results of peeling ratios at the interface between the first plated layer 34 and the second thin film 33 after 500 hours of the accelerated test are shown in Table 2.

TABLE 2

| Ni added (wt %) | 0 | 1.6 | 6.2 | 12.6 |
|---|---|---|---|---|
| Peeling ratio (%) | 15.0 | 0.0 | 0.0 | 0.0 |

As is apparent from Table 2, when Ni is added into Cu thin film, the adhesive strength at the interface between the second thin film 33 and the first plated layer 34 is greatly improved even after the accelerated test. In the above description, Cr thin film is used as the first thin film 32, but similar effects can be obtained by using a material such as Cr—Si alloy thin film, Ti thin film, or Ni—Cr alloy thin film as the first thin film. Also, the thin film is formed by a sputtering process, but similar effects can be obtained by a vacuum deposition or ion plating process.

Second Preferred Embodiment

A resistor in the second preferred embodiment of the present invention will be described in the following with reference to the drawings.

The difference of the resistor in the second preferred embodiment of the present invention from the resistor in the first preferred embodiment is that second upper electrode layer 26 is disposed in such manner as to overlap on at least a part of the upper electrode layer 22.

The second upper electrode layer 26 is disposed so as overlap on the first and the second upper electrode thin film layers 24, 25, both of which making up the upper electrode layer 22, and extend to the end portion of the substrate 21 as the same with the upper electrode layer 22. The second upper electrode layer 26 is made of so-called conductive resin prepared by dispersing conductive powder such as silver powder, carbon powder or the like into a resin. In the present embodiment, a maximum height of the second upper electrode layer 26 from the substrate is set to be higher than a maximum height of the upper electrode layer 22 from the substrate. This is intended to increase a contact area between the side electrode layer and the upper electrode layer.

By this configuration, when forming a side electrode thin film, the thin film can be continuously and reliably formed on the substrate end portion, the upper electrode layer, and partly on the substrate end surface of the second upper electrode layer because the upper electrode layer and the second upper electrode layer are flush with each other at the end portion of the substrate. Accordingly, it is possible to obtain a highly reliable resistor that can assure excellent electrical connection between the side electrode layer and the upper electrode layer.

INDUSTRIAL APPLICABILITY

As described above, the resistor of the present invention has a laminated upper electrode layer structure comprising the first upper electrode thin film layer having good adhesive strength to the substrate and resistor layer, and the second upper electrode thin film layer connected to the first upper electrode thin film layer and having the resistivity lower than the resistivity of the first upper electrode thin film layer. The improvement of the adhesive strength between the upper electrode layer and the resistor layer results in the improvement of the electrical connection between the resistor layer and the upper electrode, and at the same time, due to the second upper electrode thin film layer that is lower in resistivity, it is possible to decrease the wiring resistance of the upper electrode layer.

Further, because of good adhesive strength between the first upper electrode thin film layer of the upper electrode layer and the substrate, when a multi-piece sheet substrate is separated into individual pieces or strips of substrates, the upper electrode layer can be prevented from the peeling, and thereby, it is possible to provide a highly reliable resistor.

Also, the resistor of the present invention comprises a pair of side electrodes, electrically connected the upper electrode layer, at the end portion of the substrate, and the side electrode includes a first side thin film layer and a second side thin film layer, and the material that forms the second side thin film layer has a solid solubility with the first side thin film layer.

By this configuration, the adhesive strength will be improved between the substrate and the side electrode, between the first thin film and the second thin film, and between the second thin film and the first plated layer, and it is possible to provide a highly reliable resistor.

What is claimed is:

1. A resistor comprising:

a substrate;

a pair of upper electrode layers disposed on only one surface of said substrate, and extend to end surfaces of said substrate, said pair of upper electrode layers comprising a first thin film layer having a first resistivity, and second thin film layer having a second resistivity, said second resistivity being lower than said first resistivity;

a resistor layer connected to said pair of upper electrode layers, and a pair of side electrodes electrically connected to said pair of upper electrode layers at end portions of said substrate, and a second upper electrode layer overlapping at least a part of said pair of upper electrode layers, wherein said second upper electrode layer is formed so as to become flush with said substrate at an end portion of the substrate.

2. The resistor of claim 1, further comprising a protective layer covering at least said resistor layer.

3. The resistor of claim 1, wherein only said first thin film layer is directly connected to said resistor layer.

4. The resistor of claim 1, wherein said first thin film layer is formed of at least one selected from the group consisting of a thin film of Cr or its alloy, a thin film of Ti or its alloy, and a mixture thin film having a same composition with said resistor layer.

5. The resistor of claim 1, wherein said second thin film layer is formed of at least one selected from the group consisting of a thin film of pure noble metal or its alloy, an Al thin film, and a Cu thin film.

6. The resistor of claim 1, wherein a maximum height of said second upper electrode layer from the substrate is greater than a maximum height of said pair of upper electrode layers from the substrate.

7. The resistor of claim 1, wherein said side electrodes have a C-shape covering an upper, a side and a bottom surfaces of said substrate end portion.

8. The resistor of claim 1, wherein said side electrodes comprise a first side thin film layer and a second side thin film layer, and a material forming said second side thin film layer has a solid solubility with said first side thin film layer.

9. The resistor of claim 8, wherein said first side thin film layer is formed of at least one selected from the group of a thin film of Cr or its alloy, a thin film of Ti or its alloy, and a thin film of Ni—Cr alloy.

10. The resistor of claim 8, wherein said side electrodes further comprising:

a second thin film layer of Cu-based alloy thin film electrically connected to said first thin film;

a first plated layer made of Ni or its alloy, said first plated layer covering at least said second thin film; and a second plated layer, said second plated layer at least covering said first plated layer.

11. The resistor of claim 8, wherein said second side thin film layer is Cu—Ni alloy thin film containing 1.6% by weight or more of Ni.

12. The resistor of claim 8, wherein said first side thin film layer and said second side thin film layer are formed covering a side and a bottom surfaces of said substrate.

* * * * *